US005931743A

United States Patent [19]

Baker et al.

[11] Patent Number: 5,931,743

[45] Date of Patent: Aug. 3, 1999

[54] PUTTER HAVING CLUB HEAD WITH A GOLF-BALL ENGAGEMENT INSERT AND A SHAFT REARWARDLY OF THE INSERT

[75] Inventors: Bruce E. Baker; Edward Monett, both of Westfield, N.J.

[73] Assignee: Hustler Golf Company, Westfield, N.J.

[21] Appl. No.: 08/951,072

[22] Filed: Oct. 15, 1997

Related U.S. Application Data

[63] Continuation-in-part of application No. 08/686,499, Aug. 22, 1996, Pat. No. 5,716,290.

[51] Int. Cl.[6] ..... A63B 53/02; A63B 53/04

[52] U.S. Cl. ..... 473/313; 473/255; 473/314; 473/330; 473/340; 473/342; 473/349; 273/DIG. 8

[58] Field of Search ..... 473/342, 330, 473/349, 340, 255, 313, 314; 273/DIG. 8

[56] References Cited

U.S. PATENT DOCUMENTS

| | | | |
|---|---|---|---|
| 3,937,474 | 2/1976 | Jepson et al. | 473/342 |
| 5,310,185 | 5/1994 | Viollaz et al. | 473/330 |
| 5,460,377 | 10/1995 | Schmidt et al. | 473/340 X |
| 5,575,472 | 11/1996 | Magerman et al. | 473/342 X |
| 5,716,290 | 2/1998 | Baker et al. | 473/342 X |

*Primary Examiner*—William H. Grieb

[57] ABSTRACT

A club head for a golf club has a front surface and a rear surface and defines a frontal recess continuously perimetrically bounded by the club head front surface. A member is secured in the recess and is comprised of a material different from material constituting the club head, the member defining a front surface for hitting engagement with a golf ball.

12 Claims, 4 Drawing Sheets

PUTTER HAVING CLUB HEAD WITH A GOLF-BALL ENGAGEMENT INSERT AND A SHAFT REARWARDLY OF THE INSERT

CROSS-REFERENCE TO RELATED APPLICATION

This application is a continuation-in-part of application Ser. No. 08/686,499, filed on Aug. 22, 1996 and entitled "BALANCED PUTTER WITH TOP SPIN FACILITY", now U.S. Pat. No. 5,716,290.

FIELD OF THE INVENTION

This invention relates generally to improved golf clubs, such as putters, and pertains more particularly to golf clubs of the so-called "pendulum" type and to golf clubs embodying structure for imparting top spin to golf balls.

BACKGROUND OF THE INVENTION

As early as seventy years ago, golf club designers looked to the benefits of a pendulum-type golf club. Plant U.S. Pat. No. 1,409,966 thus speaks of enabling a golfer to use a "pendulum swing". Plant's club had a club head endwise of a club shaft, with the club head symmetrical about axes parallel to and intersecting the club shaft axis.

The pendulum club pursuit has continued over the years. Hoglund U.S. Pat. No. 3,758,115 shows a club head which has portions extending in x- and y-directions from an identified club center of gravity. A club shaft receiving recess is shown as extending through the center of gravity at a substantial angle of inclination to the z-axis. The shaft is likewise at such inclination angle, being so directed by the angulation of the recess in the club head. Hoglund advises that the resulting stroke is "a natural pendulum type of stroke with no tendency to twist or shock when the ball is struck" (column 3, lines 61–63).

Palmer U.S. Pat. No. 3,037,770 notes that a golfer's arms need move in pendulum-like manner and discloses club structure said to meet such purpose, involving also an angulation of the entire club shaft to the z-axis. A like arrangement is shown in McClure U.S. Pat. No. 1,703,199.

Baumann et al. U.S. Pat. No. 5,253,868 and U.S. Pat. No. 5,257,807 likewise note the benefits of pendulum-type clubs, using the expression "true center of gravity putter" ('807 patent, column 5, lines 59–60). The various club structures disclosed by Baumann et al. in these patents follow the Hoglund patent at least in respect of the angulation of the club head shaft-receiving recess being at a substantial angle of inclination to the z-axis.

Weight symmetry is also a disclosure of Shenoha et al. U.S. Pat. No. 5,333,863 and this patent likewise follows the Hoglund patent at least in respect of the angulation of the club head shaft-receiving recess being at a substantial angle of inclination to the z-axis. Other examples of this type of club structure are shown in Solheim U.S. Pat. No. 3,042,405 and Paquette U.S. Pat. No. 5,308,069.

In somewhat similar pursuit to pendulum-type clubs, Reinberg U.S. Pat. No. 5,176,379 talks of imparting "neutral balance" to golf clubs by the use of weight offsetting outriggers secured to a club for balancing the same. Reinberg's club head shaft-receiving recess is, unlike the foregoing patented structures, in alignment with the z-axis. Limitation is seen, however, in this arrangement in that Reinberg requires symmetry in his club head fully in the x-axis and in the y-axis aside the recess. The same may be said of the structures disclosed in Dalton U.S. Pat. No. 4,138,117.

Another consideration of long-standing in the design of golf clubs is so-called "top spin" facility. Lawton U.S. Pat. No. 1,525,137 advised in 1925 of the value of imparting curvature to a putter ball engaging surface to impart "overspin" to the ball.

The following patents show various top spin surface arrangements: Barr U.S. Pat. No. 3,989,257; Thompson U.S. Pat. No. 4,162,074; Nebbia U.S. Pat. No. 4,902,015; Tucker U.S. Pat. No. 4,964,639; Garcia U.S. Pat. No. 5,303,923 and Sneed U.S. Pat. No. 5,382,019.

Limitation is seen in that all such top spin surfaces are constituted by the same material as the club head.

By way of further indication of prior art practices in the design of golf clubs, note is made of Clark et al. U.S. Pat. No. 4,253,667 and Tucker U.S. Pat. No. 4,964,639. Clark et al. advise of weighting practices, such as forming cavities in club heads and loading the cavities with shot held in place by a matrix. Tucker discloses application of a resilient member, such as a polyurethane rubber, to the front face of a putter to provide "feel" and protection.

SUMMARY OF THE INVENTION

A primary object of the present invention is the provision of improved golf clubs and golf club heads.

Particular objects of the invention are to provide improved pendulum-type golf clubs and top spin imparting structures.

In attaining the above and other objects, the invention provides, in combination, a club head for a golf club, the club head having a front surface and a rear surface and defining a frontal recess continuously perimetrically bounded by the club head front surface; and a member secured in the recess and comprised of a material different from material constituting the club head, the member defining a front surface for hitting engagement with a golf ball.

The invention will be further understood from consideration of the following description of preferred embodiments thereof and from the drawings where like reference numerals identify like parts throughout.

DETAILED DESCRIPTION OF PREFERRED EMBODIMENTS

Figure 2:
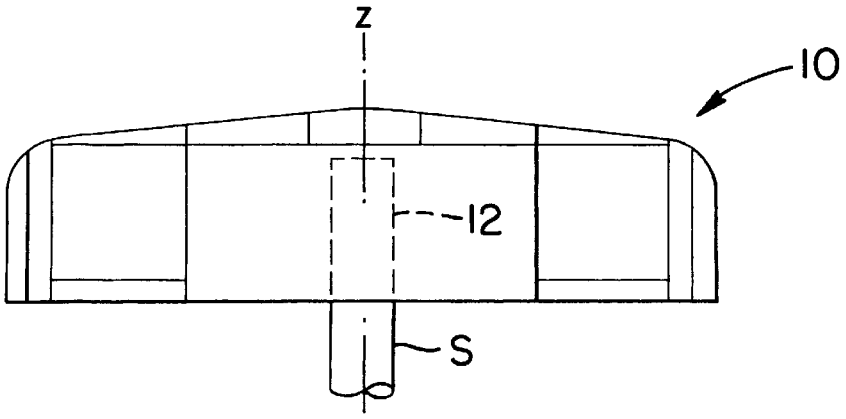
FIG. 2 is a view as would be seen rearwardly of FIG. 1, showing also a portion of a golf club shaft secured to the first golf club head.
Figure 1:
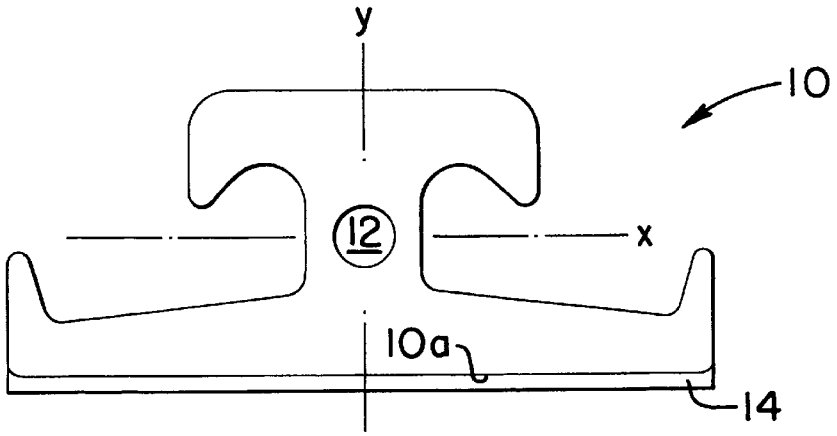
FIG. 1 is a top plan view of a first golf club head in accordance with the invention.
Figure 3:
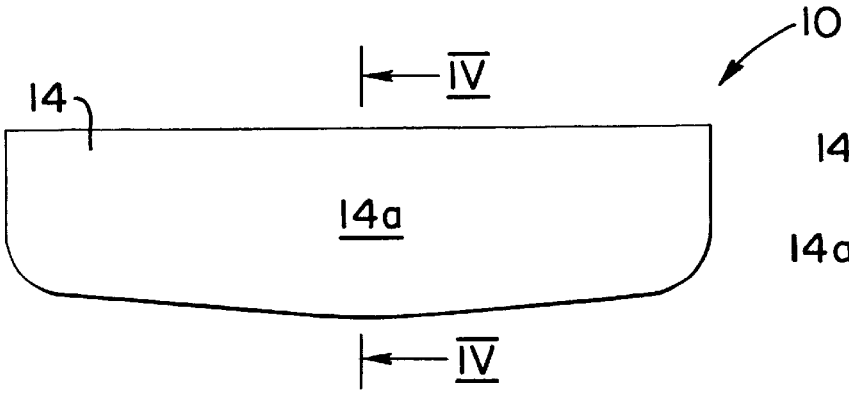
FIG. 3 is a view as would be seen forwardly of FIG. 1.

Referring to FIGS. 1–3, golf club head 10 has shaft receiving recess 12 coincident with the center of gravity thereof and body portions extending along mutually orthogonal axes x and y.

Golf club shaft S is secured in top recess 12, the recess extending along a z-axis orthogonal to the axes x and y. The illustrated end portion of shaft S will be seen to be likewise disposed to extend along the z-axis under the urging of the sidewall of recess 12. Shaft S may be inclined otherwise over the further extent thereof leading to its grip end (not shown).

Head 10 exhibits geometric symmetry in its body portions on opposite x-axis sides of recess 12, but geometrical symmetry does not attend its body portions which are located on opposite y-axis sides of recess 12.

Figure 4:
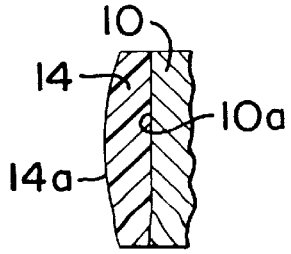
FIG. 4 is a partial, sectional view as would be seen from plane IV—IV of FIG. 3.

Secured to front face 10*a* of head 10 is a resilient member 14 which has an arcuate surface 14*a* distal from face 10*a*, as is seen in FIG. 4, to provide the club head with facility for imparting top spin to a golf ball thereby engaged and otherwise to provide protection of the club head from scratching, denting, marring and the like. Applicants have found a polyurethane elastomer, commercially available from Dow Chemical under the tradename PELLETHANE 2103-90AEF Polymer, as particularly effective in these respects in that members formed thereof exhibit zero-compression and readily return to exhibit the desired arcuate surface upon being acted upon by golf balls or accidental engagement with other objects.

Turning to FIGS. 5–8, a second golf club head 110 has shaft receiving recess 112 coincident with the center of gravity thereof and body portions extending along mutually orthogonal axes x and y.

As in the case of recess 12 of the first embodiment, top recess 112 extends along a z-axis orthogonal to the axes x and y and its sidewalls will urge a seated end portion of a shaft to be likewise disposed to extend along the z-axis.

Head 110 exhibits geometric symmetry in its body portions on opposite x-axis sides of recess 112, but geometrical symmetry does not attend its body portions which are located on opposite y-axis sides of recess 112.

Figure 8:
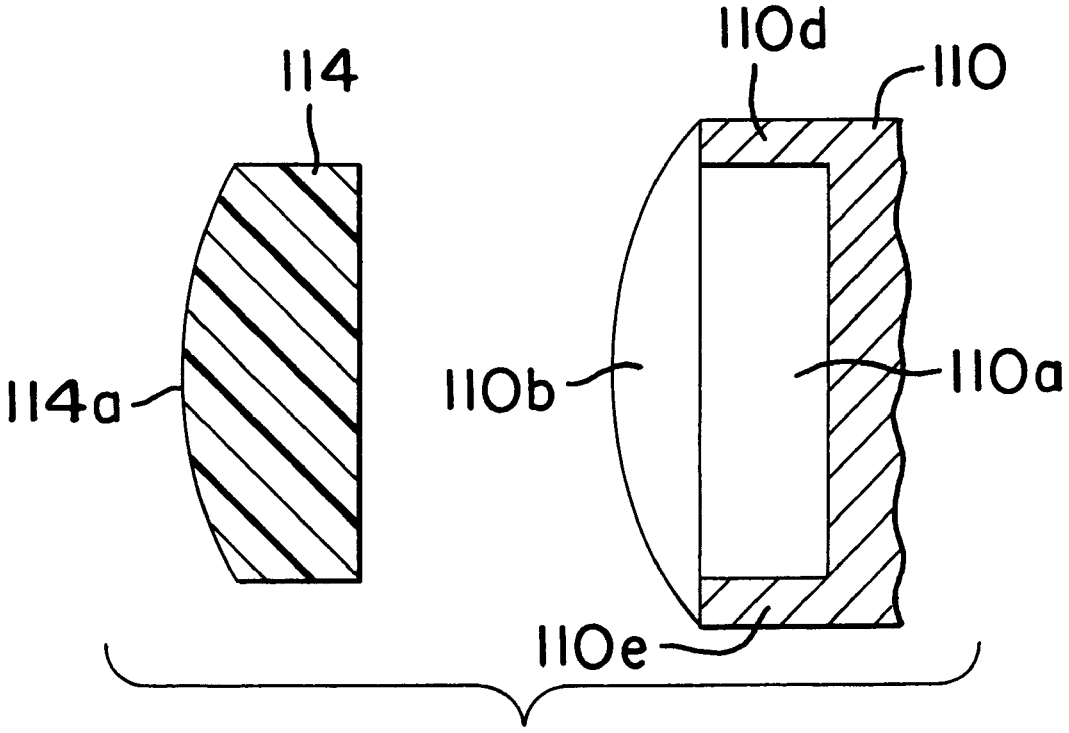
FIG. 8 is an exploded, partial, sectional and enlarged view as would be seen from plane VIII—VIII of FIG. 7.

Referring to FIG. 8, head 110 defines a recess 110a at its front face, into which resilient member 114 is inserted and secured. Resilient member 114 has an arcuate surface 114*a* disposed outwardly of recess 110*a* and is preferably constituted of the above-mentioned urethane polymer, serving the same purposes as above discussed for the first embodiment. The planar rear surface of resilient member 114 extends vertically in continuous engagement with club head 110 forwardly of top recess 112.

The forward portion of head 110 is configured with eave-like portions 110*b*, 110*c*, 110*d* and 110*e* (FIG. 7) to nest member 114 in recess 110*a*. Per the invention, the sideward eave-like portions 110*b* and 110*c* exhibit arcuate configuration corresponding to the arcuate configuration of member 114, such as is shown for eave-like member 110*b* in FIG. 8.

The embodiment of FIGS. 5–8 will be seen to involve a club head for a golf club, the club head having a front surface and a rear surface, wherein a frontal recess is continuously perimetrically bounded by the club head front surface. A member secured in the recess, i.e., nested therein with the club head front surface continuously perimetrically bounding the member, is comprised of a material different from material constituting the club head, the member defining a front surface for hitting engagement with a golf ball.

Figure 6:
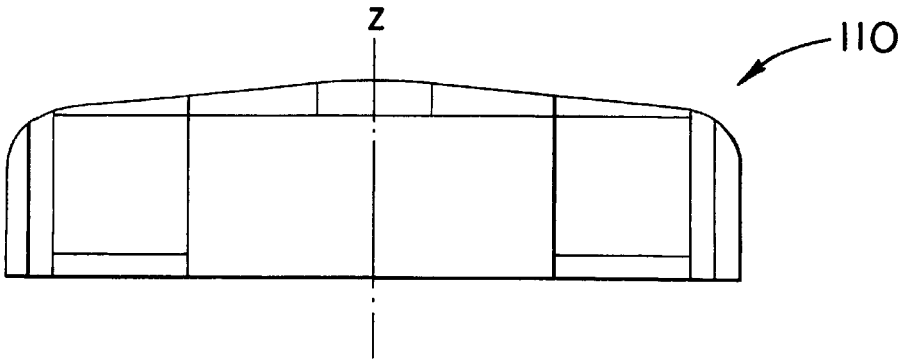
FIG. 6 is a view as would be seen rearwardly of FIG. 5.
Figure 5:
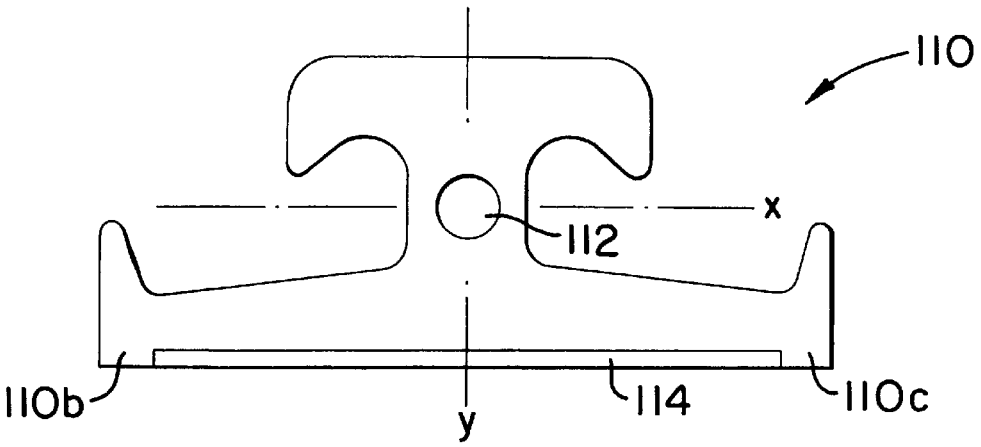
FIG. 5 is a top plan view of a second golf club head in accordance with the invention.
Figure 7:
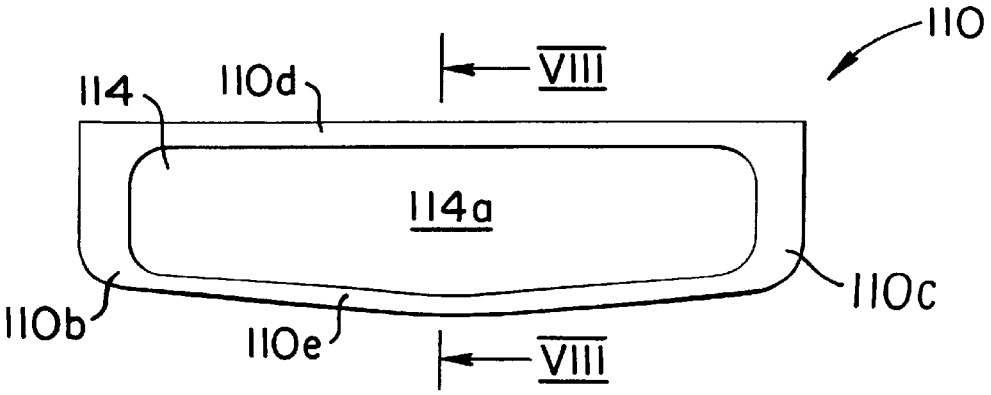
FIG. 7 is a view as would be seen forwardly of FIG. 5.
Figure 9:
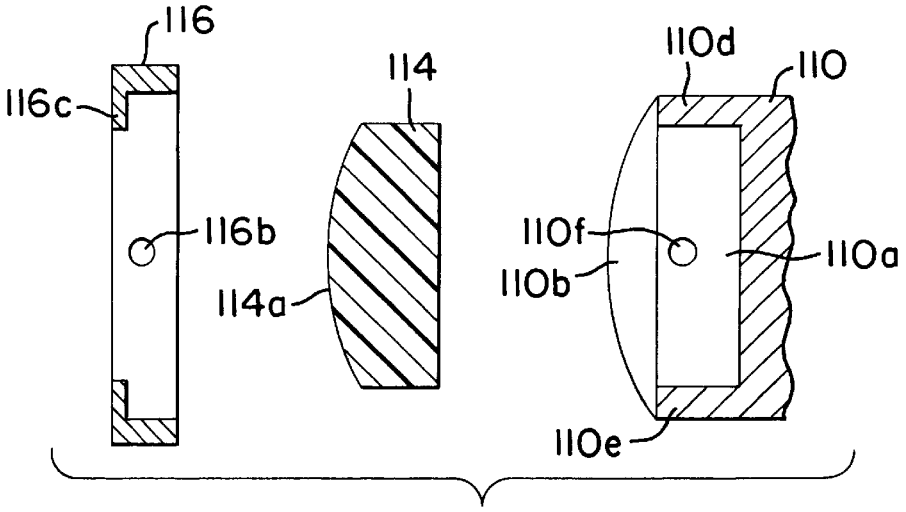
FIG. 9 is an exploded, partial, sectional and enlarged view of a further embodiment of the invention.
Figure 10:
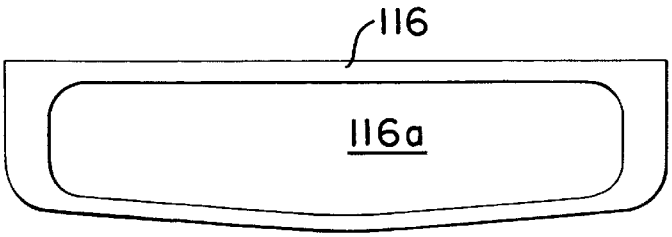
FIG. 10 is a front elevation of the insert retention element of FIG. 9.
Figure 11:
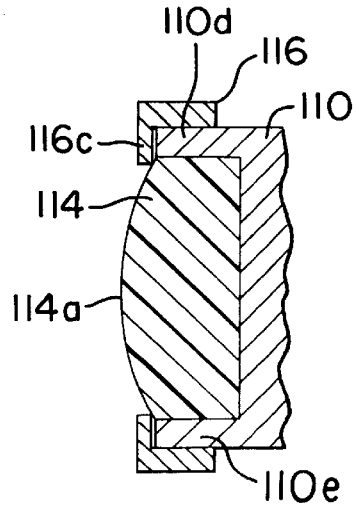
FIG. 11 depicts in central section an assembly of the components of FIG. 9.

Referring to the embodiment of FIGS. 9–11, as in the embodiment of FIGS. 6–8, head 110 defines a recess 110*a* at its front face, in which resilient member 114 is nested. An insert retention element 116 has a central opening 116*a*, the bounding perimeter of which follows the configuration of member 114 but is of slightly less expanse than member 114, so as to function to retain member 114 when element 116 is secured to head 110. For such securement purposes, head 110 defines sideward threaded openings, one being shown at 110*f* and element 116 has sideward openings, one being shown at 116*b*.

Element 116 is of such dimension that it may be slid onto the outer perimeter of head 110, whereupon screws (not shown) are inserted through openings 116*b* to engage the threads of openings 110*f*.

As is seen in FIGS. 9–11, front flange 116*c* of element 116 is of such length perimetrically thereof as to engage the outermost circumference of member 114, retaining the same securely with head 110.

Club heads in accordance with the invention may be constituted of various metals and metal alloys. Weighting thereof to define a position of the center of gravity for placement of the club head recess may be performed as noted in prior art discussion as aforesaid.

Various changes to the particularly depicted embodiments of the invention may be introduced without departing from the scope of the invention. Accordingly, it is to be appreciated that the particularly disclosed clubs and club heads are intended in an illustrative, and not in a limiting, sense. The true spirit and scope of the invention is set forth in the ensuing claims.

What is claimed is:

1. In combination:

(a) a club head for a golf club, the club head having a front surface, a rear surface and a top surface and defining a frontal recess continuously perimetrically bounded by said club head front surface and a top recess extending vertically into said club head at a location centrally of said club head; and (b) a member secured in said frontal recess and comprised of a material different from material constituting the club head, the member defining a front surface for hitting engagement with a golf ball and a planar rear surface extending vertically in continuous engagement with said club head forwardly of said club head top recess.

2. The invention claimed in claim 1, wherein said member front surface is of arcuate configuration frontally of the club head front surface.

3. The invention claimed in claim 2, wherein the front surface of the club head has the same arcuate configuration frontally of the club head front surface as the member front surface.

4. The invention claimed in claim 1, wherein said member is comprised of a polyurethane elastomer.

5. The invention claimed in claim 1, further comprising a retention element overlapping a boundary of said member and secured to said club head.

6. The invention claimed in claim 5, wherein said retention element is secured to at least one side of said club head.

7. A golf club, comprising:

(a) a club shaft;

(b) a club head having a front surface, a rear surface and a top surface and defining a frontal recess continuously perimetrically bounded by said club head front surface and a top recess extending vertically into said club head at a location centrally of said club head, said club shaft being secured in said top recess; and (c) a member secured in said frontal recess and comprised of a material different from material constituting the club head, the member defining a front surface for hitting engagement with a golf ball and a planar rear surface extending vertically in continuous engagement with said club head forwardly of said club head top recess.

8. The invention claimed in claim 7, wherein said member front surface is of arcuate configuration frontally of the club head front surface.

9. The invention claimed in claim 8, wherein the front surface of the club head has the same arcuate configuration frontally of the club head front surface as the member front surface.

10. The invention claimed in claim 7, wherein said member is comprised of a polyurethane elastomer.

11. The invention claimed in claim 7, further comprising a retention element overlapping a boundary of said member and secured to said club head.

12. The invention claimed in claim 11, wherein said retention element is secured to at least one side of said club head.

* * * * *